United States Patent [19]

Johansson et al.

[11] Patent Number: 4,706,638

[45] Date of Patent: Nov. 17, 1987

[54] IGNITION UNIT IN THE IGNITION SYSTEM OF AN INTERNAL COMBUSTION ENGINE

[75] Inventors: Sven H. Johansson; Jan G. Nytomt, both of Åmål, Sweden

[73] Assignee: Saab-Scania Aktiebolag, Sodertalje, Sweden

[21] Appl. No.: 880,926

[22] Filed: Jun. 27, 1986

Related U.S. Application Data

[62] Division of Ser. No. 719,272, filed as PCT SE 84/00243, Jan. 28, 1984, published as WO 85/00930, Feb. 28, 1985, Pat. No. 4,617,907.

[30] Foreign Application Priority Data

Aug. 5, 1983 [SE] Sweden ..... 8304283

[51] Int. Cl.[4] ..... F02P 3/02

[52] U.S. Cl. ..... 123/647; 123/635

[58] Field of Search ..... 123/594, 634, 635, 647, 123/143 R, 143 C, 146.5 R, 146.5 A

[56] References Cited

U.S. PATENT DOCUMENTS

| | | | |
|---|---|---|---|
| 1,110,415 | 9/1914 | Zika | 123/146.5 A |
| 1,532,292 | 4/1925 | Woolson | 123/634 |
| 2,478,128 | 8/1949 | Peters | 123/143 C |
| 4,195,611 | 4/1980 | Wörz et al. | 123/635 |
| 4,248,201 | 2/1981 | Tsutsui et al. | 123/647 |
| 4,324,219 | 4/1982 | Hayashi | 123/169 PA |
| 4,392,473 | 7/1983 | Tsutsui et al. | 123/635 |

FOREIGN PATENT DOCUMENTS

| | | | |
|---|---|---|---|
| 1498942 | 1/1978 | United Kingdom | 123/635 |

*Primary Examiner*—Andrew M. Dolinar
*Attorney, Agent, or Firm*—Cushman, Darby & Cushman

[57] ABSTRACT

A cartridge unit included in an ignition system of an internal combustion engine includes an upper metal part which is securable to an adjacent part of the engine and a plurality of finger-like connection casings, one for each spark plug, detachably mounted to and extending from the upper part. The connection casings and the upper part, when attached to each other, form an essentially closed inner space encapsulating a high tension block which includes a plurality of ignition coils for generating ignition voltage. Each ignition coil has a cable-free detachable electrical connection with adjacent parts of the high tension block, a plurality of contacts, one in each connection casing for cable-free transmission of high tension current from the ignition coils to the spark plugs, and a plurality of sealing elements, one for each connection casing, each sealingly surrounding a spark plug when the cartridge unit is connected to the spark plugs, a plurality of the finger-like connection casings being formed in one piece attachable to the upper part of the cartridge unit.

9 Claims, 4 Drawing Figures

IGNITION UNIT IN THE IGNITION SYSTEM OF AN INTERNAL COMBUSTION ENGINE

This is a division of application Ser. No. 719,272, filed Apr. 2, 1985, U.S. Pat. No. 4,617,907.

The present invention relates to an ignition unit included in the ignition system of an internal combustion engine and including a plurality of finger-like connection pieces extending from a common upper part in the ignition unit and connectible to a corresponding number of spark plugs in the engine, said upper part including an electronic unit with components included in a high-tension block, each connection piece including an ignition element with an ignition coil for generating ignition voltage, as well as a connection device for connecting and for transmitting high-tension current to the engine spark plugs.

The basic features of an ignition unit of the kind in question are described in our earlier Swedish Pat. Application No. 8204248-2, as well as the advantages which can be attained from the function and service aspects.

The present invention is a further development of an ignition unit exemplified in the application mentioned. The invention has the object of facilitating rational manufacturing of the parts included in the ignition unit and enabling reliable and loss-free transmission of high-tension current to the engine spark plugs during comparatively long periods also. The invention is thus distinguished chiefly by each ignition element of the ignition unit having cable-free electrical connection both to contact means in the upper part and to contact means in its connection device.

By the complete absence of current-carrying cables, not only between the ignition element and the connection device but also between the upper part and the ignition element, the implementation of the ignition unit and its fitting are facilitated while at the same time the risk of electrical faults is substantially reduced. The latter can also be explained by each ignition element being enclosed in a surrounding protective sleeve, which promotes loss-free and problem-free transmission over the contacts between the ignition element and the upper part as well as between the ignition element and the connection device even for difficult operating conditions.

In an advantageous embodiment of the ignition unit, each protective sleeve constitutes a porton of an integral outer casing which encloses the respective ignition elements and is mountably attached to the upper part of the ignition unit. There is thus enabled rational manufacture of the outer casing integrated with the sleeves and furthermore, mounting and removal of the ignition unit is facilitated.

Figure 4:
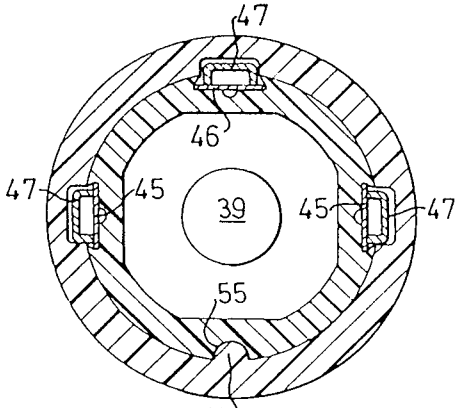

Other distinguishing features of the invention are apparent from the accompanying claims and the following description of an advantageous embodiment exemplifying the invention. The description is made with reference to the accompanying figures, of which FIG. 1 is a side view of a part of an ignition unit, FIG. 2 is a cross section A—A according to FIG. 1, FIG. 3 is a longitudinal section through a connection piece, substantially according to section B—B in FIG. 1, and FIG. 4 is a cross section C—C through the connection piece according to FIG. 3.

Figure 1:
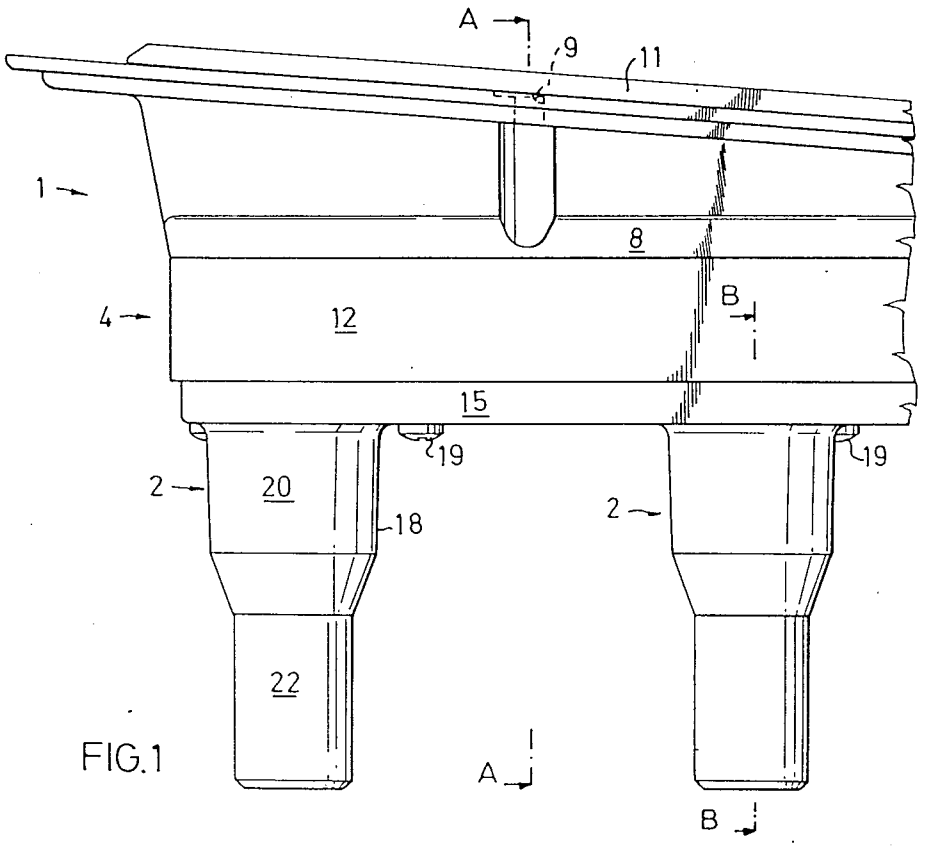
Figure 2:
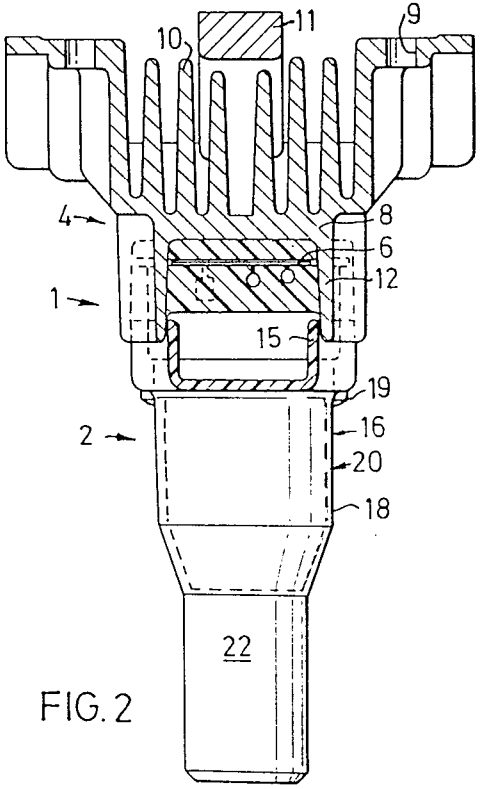

It will be seen from FIGS. 1 and 2 that an inventive ignition unit 1 is formed with a plurality of dependent finger-like connection pieces 2. They extend from an upper part 4 common to all connection pieces 2, there being included in the upper part 4 an electronic unit (not shown) with components included in a high-tension block, i.e. components in the vehicle ignition system operating at voltages over 12 volts. These components are suitably included in circuit-boards 6 embedded in epoxy plastics or the like according to known so-called "solid state" technique. The uniting member of the upper part is an aluminium carrying section 8, which is intended to be fastened directly to supporting portions of an Otto engine (not shown), e.g. to the valve cover parts. Attachment is made by a plurality of screws (not shown) passing through screw-holes 9 in the upper part of the section 8. The section 8 is also provided with a plurality of upwardly directed cooling fins 10, and above them the ignition unit 1 is formed with a gripping rail 11. The latter can be used as a handle in fitting and removing the ignition unit 1 to and from the engine.

On its underside, the upper carrying section 8 is formed with two longitudinal flanges 12 which define the extent of the upper part 4 laterally. The flanges 12 reach over two upwardly directed longitudinal flanges 15 situated between them and provided on an outer casing 16 common to all the connection pieces 2. The casing 16 is moulded integrally in plastics and formed with a plurality of dependent protective sleeves 18, which are arranged to surround a corresponding number of connection pieces 2 coacting with the upper part 4. The casing 16 is firmly attached to the carrying section 8 with the aid of a number of screws 19.

Figure 3:
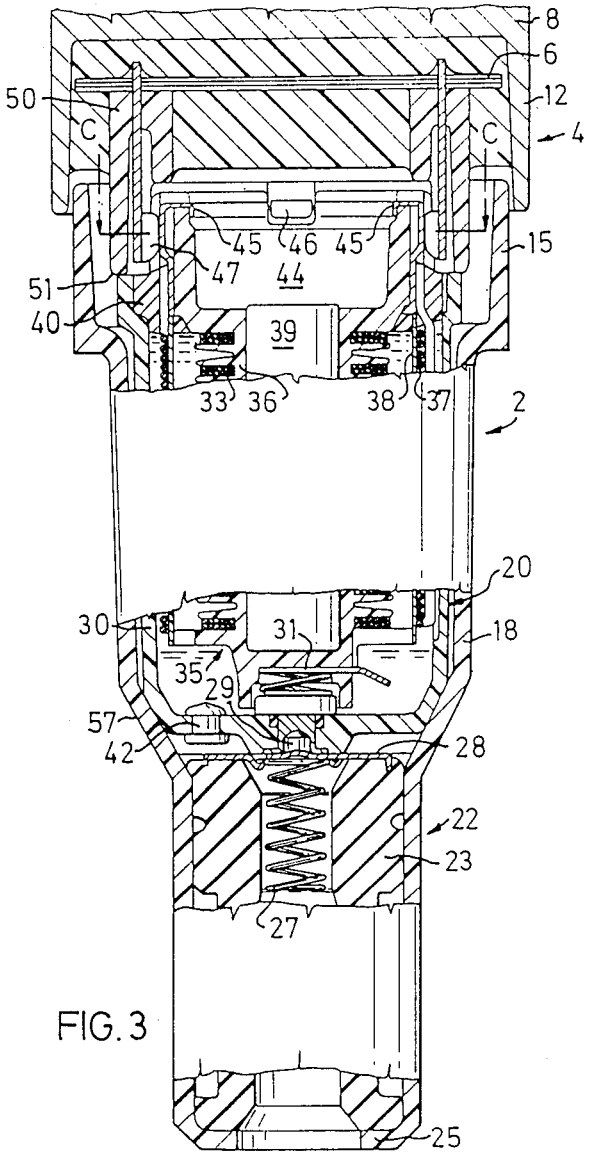

FIG. 3 illustrates a connection piece 2, the main parts of which are an ignition element 20 and a connection device 22. Each such connection piece 2 is surrounded and retained by a protective sleeve 18 integral with the outer casing 16. Each connection device 22 comprises an elastic rubber sleeve 23 arranged in the bottom portion of the protective sleeve 18, the lower part of the rubber sleeve 23 bearing against a radially inwardly formed flange 25 on the lower end of the sleeve 18, the upper part of the rubber sleeve 23 being adapted axially to bear against the underside of an outer casing 30 at the ignition element 20. The rubber sleeve 23 is intended to seal tightly against the insulator part of the unillustrated spark plug when the connection piece 2 is thrust via the connection device 22 onto the spark plug. The central electrode of the spark plug then engages against a contact means 27 formed as a helical spring, which via a washer 28 guided in the upper end of the rubber sleeve 23 is pressed into engagement against the underside of a rivet 29 in the outer casing 30 of the ignition element 20. The rivet passes through the bottom of the casing 30, and via a helical spring 31 in the ignition element 20, the ignition voltage from the secondary winding 33 of an ignition coil 35 enclosed in the ignition element 20 can be transmitted to the spark plug.

The secondary winding 33 is tightly wound on a moulded plastics bobbin 36 with annular compartments and inside the primary winding 37 of the ignition coil 35, the primary winding 37 being sparsely wound on a thin-walled bobbin 38. The central portion of the ignition coil 35 is a conventional ferrite core 39.

In the solution illustrated in FIG. 3, the element 20 is a separately handleable unit, where the ignition coil 35 is inserted into and fixed to the outer casing 30 which limits the ignition element 20. Said fixation is achieved by an annular gap 40 between the outer end portion of the casing 30 and the plastics bobbins 36,38 of the ignition coil being sealingly filled with moulding plastics. The chamber enclosed by the casing 30 is then filled with an insulating oil via a hole situated at the opposite end of the casing 30, this hole being subsequently closed off by a plug 42.

The plastics bobbin 36 of the ignition coil 35 is formed with an open support cylinder 44 facing towards the upper part 4, three contact tabs 45,46 being arranged in the support cylinder 44 in grooves on the outer curved surface thereof. Two of these tabs 45 connect the primary winding of the ignition coil 35 to such as a capacitive ignition system discharge circuit, while the third tab 46 connects the secondary winding of the ignition coil 35 to an ignition circuit in which there are included parts of the high-tension block of the electronic unit. Sprung contact tongues 47 engage against the contact tabs 45,46, the former being connected to the electronic unit circuit board 6. The contact tongues 47 are fastened to a support ring 50 moulded into the electronic unit. The support ring 50 is formed with an end surface 51 facing towards the element 20, this end surface being intended to sealingly coact with a corresponding annular surface on the element 20, whereby the contact means 45,46,47 are protected from moisture and contamination from the outside. The support cylinder 44 on the element 20 assumes a thrust-in position in the support ring 50 and is held non-rotatable by an axial ridge 53 formed on the support ring 50 and coacting with an axial groove 55 made in the support cylinder 44. The contact means 45,46,47 engaging against each other are thus unloaded from outside forces other than the contactforming spring bias.

The protective sleeve 18 surrounding the ignition element 20 is formed with an inwardly conical portion 57 coacting with a complemental conical portion on the lower end of the ignition element 20. When the outer cover 16 is fastened to the carrying section 8 of the upper part 4, the ignition element 20 is thus fixed to the support ring of the upper part 4 before their positions are finally secured relative to each other. By the radial flange 25 formed at the lower end of the protective sleeve 18 there is obtained a force on the inner rubber sleeve 23 of the connection device 22 when removing the ignition unit 1 from the spark plugs, this force limiting the tendency to an increase in the gripping force of the sleeve 23 which otherwise is customary for such a withdrawal.

The described embodiment must not be considered limiting for the invention, but within the scope of the following claims the latter can be modified in a plurality of embodiments. With the aim of obtaining the highest operational reliability, the ignition elements 20 and the outer casing can be moulded directly into the upper part 4, for example, although the possibility of exchanging separate parts in the ignition unit 1 will be limited. In such a case the connection device 22 may be made exchangeable by the lower portion of the protective sleeve 18 being removably attached to the sleeve portion attached to the upper part 4. Neither is it to be regarded an necessary for the invention that the sleeves are integrated in an integrally formed outer casing 16 but with retained advantage they may be formed as separate units.

We claim:

1. A cartridge unit included in an ignition system of an internal combustion engine and connectible to a plurality of spark plugs in the engine, said cartridge unit comprising an upper part securable to adjacent engine parts, a number of finger-like connection casings detachably mounted to the upper part and extending from the upper part, one casing, for each spark plug, said connection casings and upper part, when attached to each other, forming together an outer shell with an essentially closed inner space encapsulating a high tension block comprising at least one ignition coil for generating ignition voltage, each ignition coil having a cable-free detachable electrical connection with adjacent electrical components in the high tension block, the high tension block also comprising a number of contact means, one in each connection casing, which contact means establish a resilient cable-free detachable connection between one ignition coil and one spark plug, for transmission of high tension current from the ignition coil to the spark plug, and a plurality of sealing elements, one for each connection casing, each sealingly surrounding a spark plug when the cartridge unit is connected to the spark plug.

2. A cartridge unit as claimed in claim 1 in which each finger-like connection casing is attachable as a single part to the upper part.

3. A cartridge unit as claimed in claim 1 in which all the finger-like connection casings are formed in one piece attachable to the upper part.

4. A cartridge unit as claimed in claim 3 in which the upper part has downwardly extending flanges cooperating with the connection casings to form the inner space.

5. A cartridge unit as claimed in claim 4 in which the upper part is a metal bar securable to adjacent engine valve cover parts, and in which the connection casings are formed in a plastics material.

6. A cartridge unit as claimed in claim 5 in which the metal bar is integrally formed with upwardly extending cooling flanges.

7. A cartridge unit as claimed in claim 1 in which each sealing element has an outer surface, which is essentially fully surrounded by one of the connection casings.

8. A cartridge unit as claimed in claim 1, in which each sealing element surrounds a contact means.

9. A cartridge unit included in an ignition system of an internal combustion engine and connectible to a plurality of spark plugs in the engine, said cartridge unit comprising an upper metal part formed substantially as a bar, which is securable to adjacent engine valve cover parts, a number of finger-like connection casings, one for each spark plug, detachably mounted to and extending from the upper part, said connection casings and upper part, when attached to each other, forming an essentially closed inner space encapsulating a high tension block comprising a number of ignition coils for generating ignition voltage, each ignition coil having a cable-free detachable electrical connection with adjacent parts of the high tension block, a number of contact means, one in each connection casing, for cable-free transmission of high tension current from the ignition coils to the spark plugs, and a plurality of sealing elements, one for each connection casing, each sealingly surrounding a spark plug when the cartridge unit is connected to the spark plugs, a plurality of the finger-like connection casings being formed in one piece attachable to the upper part.

* * * * *